US005724852A

United States Patent [19]

Lee

[11] Patent Number: 5,724,852

[45] Date of Patent: Mar. 10, 1998

[54] PORTABLE SMALL REBAR BENDING MACHINE

[76] Inventor: Jimmy Dale Lee, 7787 La Mesa, Buena Park, Calif. 90620

[21] Appl. No.: 691,397

[22] Filed: Aug. 2, 1996

[51] Int. Cl.[6] ..... B21D 7/08

[52] U.S. Cl. ..... 72/389.6; 72/213; 72/453.15

[58] Field of Search ..... 72/389.1, 389.6, 72/389.7, 453.16, 212, 213, 453.15

[56] References Cited

U.S. PATENT DOCUMENTS

| | | | |
|---|---|---|---|
| 3,908,425 | 9/1975 | Ware | 72/389.8 |
| 4,558,583 | 12/1985 | Shaw, Sr. et al. | 72/389.6 |
| 5,237,847 | 8/1993 | Owens | 72/389.1 |
| 5,528,921 | 6/1996 | Herman | 72/389.6 |

FOREIGN PATENT DOCUMENTS

| | | | |
|---|---|---|---|
| 1228685 | 8/1960 | France | 72/389.8 |
| 63-171219 | 7/1988 | Japan | 72/389.6 |
| 3701 | 8/1881 | United Kingdom | 72/389.1 |

*Primary Examiner*—David Jones
*Attorney, Agent, or Firm*—Morland C. Fischer

[57] ABSTRACT

The portable small bending machine has a frame with first and second spaced anvils. A cylinder is mounted on the frame to pull a bending die between the anvils to bend rebar therebetween.

17 Claims, 5 Drawing Sheets

10
46
38
40
44
20
24
16
42
14
17
26
18
28
30
22
32
34
36
48
12
52
50

PORTABLE SMALL REBAR BENDING MACHINE

FIELD OF THE INVENTION

The present invention relates to the field of construction equipment. More specifically, the present invention relates to a fluid pressure operated, portable machine for efficient bending of steel reinforcing bar with minimum effort and maximum safety for the user.

BACKGROUND OF THE INVENTION

In construction, reinforcing steel may be supplied in a variety of different forms. Typically, the reinforcing steel is known as rebar and is available in a variety of diameters and textures. The most common texture is that of a double helical raised spiral surface, which forms a pair of opposite spiral patterns as viewed from one end of the rebar to the other. The raised spiral surfaces enable the bar to engage the concrete and is commonly known as deformed bar or rebar.

Rebar is placed into concrete forms to increase the tensile strength of the completed reinforced concrete structure. Often, a rebar structure is prebuilt, sometimes on the job site and sometimes away from the job site. This prebuilt rebar assembly is then placed into the form. In many types of construction, whether using rebar preassemblies or placing rebars into the form on site, is often necessary to leave the rebar ends straight where they extend from the concrete structure. In those cases, the extending ends will need to be left straight until after pouring since the level of the concrete may vary depending on the accuracy of the pour. The shape and amount of the rebar which extends after the concrete is poured is important to the structural integrity of the concrete structure which will be poured later. The placement of rebar bends in the second poured concrete structure is important to strength of the whole structure, and the placement of these bends is related to the finished surface of the first poured concrete structure. Thus, such bends must be made after the first concrete structure is poured. The tensile force parallel to the rebar as it extends from the concrete will not wholly be translated into an axial force with respect to the rebar in the concrete. A sharper bend is associated with the creation of force against the bend, whereas a shallow bend enables the rebar to exert more of an axial pulling force in the concrete into which it is placed.

Further, the structural integrity of the exposed rebar itself is critical to the concrete structure which is poured around the extending rebar. Where the rebar is bent without aid, a sharp bend is made at the surface of the concrete. This is especially harmful and can virtually eliminate the usefulness of the exposed rebar. In the best case, the rebar can simply break off. At least a complete failure will form an overt indication that there is no rebar to use. A complete failure may cause the complete repouring of the structure, but at least it will not lead to reliance on the damaged structure and, therefore, result in a later failure and possible loss of lives.

Other rebar bending methods may involve the manual bending of the rebar around an object placed adjacent the rebar where it extends from the concrete. In some cases, the object will move causing most of the bending to be of small radius at the concrete surface, with only a large radius applied to the remainder of the rebar. In this case, the construction inspector may be misled into believing that the rebar is properly bent when, in fact, the structural damage done is equivalent to that for a sharp angle bend.

Further, the size of the rebar can cause a different result for different objects over which the rebar is bent. The radius of the bend needs to be related to the size of the rebar. A one inch diameter rebar should not be bent about a one-half inch radius and, conversely, a one-quarter inch rebar should not be bent about a 10-inch radius.

It is for these reasons that a well-placed bend of proper curvature is so important to enable the resulting structure to maximally take advantage of the full strength available in the rebar, as well as the holding force of the rebar, which extends parallel to and along the surface of the concrete from which it extends. One result of the need for proper placement is the need to have an even radiused bend occur at different selected heights above the surface of the concrete. Where an object is used to assist the bending of the rebar, it will usually not have the stability to enable the bend to occur at different selected heights. Where the person bending the rebar is using force about an object, the object must be of the correct radius and have an adequate height.

Such a bending object would be prohibitive to be placed between extending lengths of rebar, particularly where the spacing is narrow, such as between about six inches and one foot. Further, workers may not be expected to physically transport such a bending object and may require the help of a crane. Even where a structure for rebar bending is employed, the construction worker must still effect the bending. Typically, this is done with mechanical advantage by the use of a pipe placed over the end of the rebar combined with tugging and pulling on the pipe. Even where a properly diameter bending device is present, such haphazard bending is problematic for a number of reasons.

First, the bend may still not be proper. Second, the time for physical manipulation is prohibitive. Third, the bending may "trap" the bending device about which the rebar is bent. The time consumed for a single worker to bend each rebar set, which is prohibitive, will be even worse if manual bending results in a trap of the structure. A trapped structure can cause the worker to have to bend the bar back to free the structure. Bending the rebar both ways significantly weakens the rebar.

When rebar is formed into a spiral to serve as the reinforcement in a column, California Construction Code requires proper termination of the end of the rebar. One proper termination is the welding of the end to the end of the spiral rebar in the adjacent spiral, with a 1 foot overlap. The other proper termination is the provision of a 135 degree bend at the end of the rebar in the spiral. The portable small rebar bending machine of this invention is particularly useful in placement of that 135 degree end bend on the rebar.

What is needed, therefore, in the construction field is a device and method for enabling the quick, safe, easy and sure bending of rebar. The needed device should have a number of characteristics which give it utilitarian advantages on the job. The characteristics should include the inability of the device to become "trapped." The bending should be able to be achieved at varying heights above the level of the concrete surface. The bending should always produce an even radius of curvature. The bending should be automatic to eliminate the energy expenditure by the construction worker. The device used for bending should be portable and as lightweight as possible to facilitate its use between closely set rebar and also at elevations significantly above ground level.

SUMMARY OF THE INVENTION

In order to aid in the understanding of this invention, it can be stated in essentially summary form that it is directed to a portable small rebar bending machine which has a frame. First and second spaced anvils are mounted on the frame, and a fluid cylinder is mounted on the frame to pull a bending die between the anvils. A rebar is engaged on one side by the two spaced anvils and on the opposite side by the bending die. Actuation of the cylinder moves the bending die between the anvils to locally bend the rebar. The bending die may be in the form of a cylinder or may be in the form of a rotatable wheel.

It is, thus, a purpose and advantage of this invention to provide a portable small rebar bending machine which can be taken to the job site to locally bend rebar, which may be free or may be partially embedded in a concrete structure.

It is a further purpose and advantage of this invention to utilize hydraulic power in the bending of rebar at the job site, as compared to manual power.

It is a further purpose and advantage of this invention to provide a portable small rebar bending machine which is capable of bending small rebar in confined locations and which is demountable so that it can be readily removed from such confined locations after the rebar is bent.

It is a further purpose and advantage of this invention to provide a rebar bending machine which has a high force-to-weight ratio by virtue of using hydraulic pressure and which is compact so that it can be readily manually placed in constricted locations.

It is another purpose and advantage of this invention to provide a rebar bending machine which is particularly useful in providing a 135 degree bend close to the end of a rebar to provide a termination of the rebar.

Other purposes and advantages of this invention will become apparent from a study of the following portion of the specification, the claims and the attached drawings.

DESCRIPTION OF THE PREFERRED EMBODIMENTS

Figure 1:
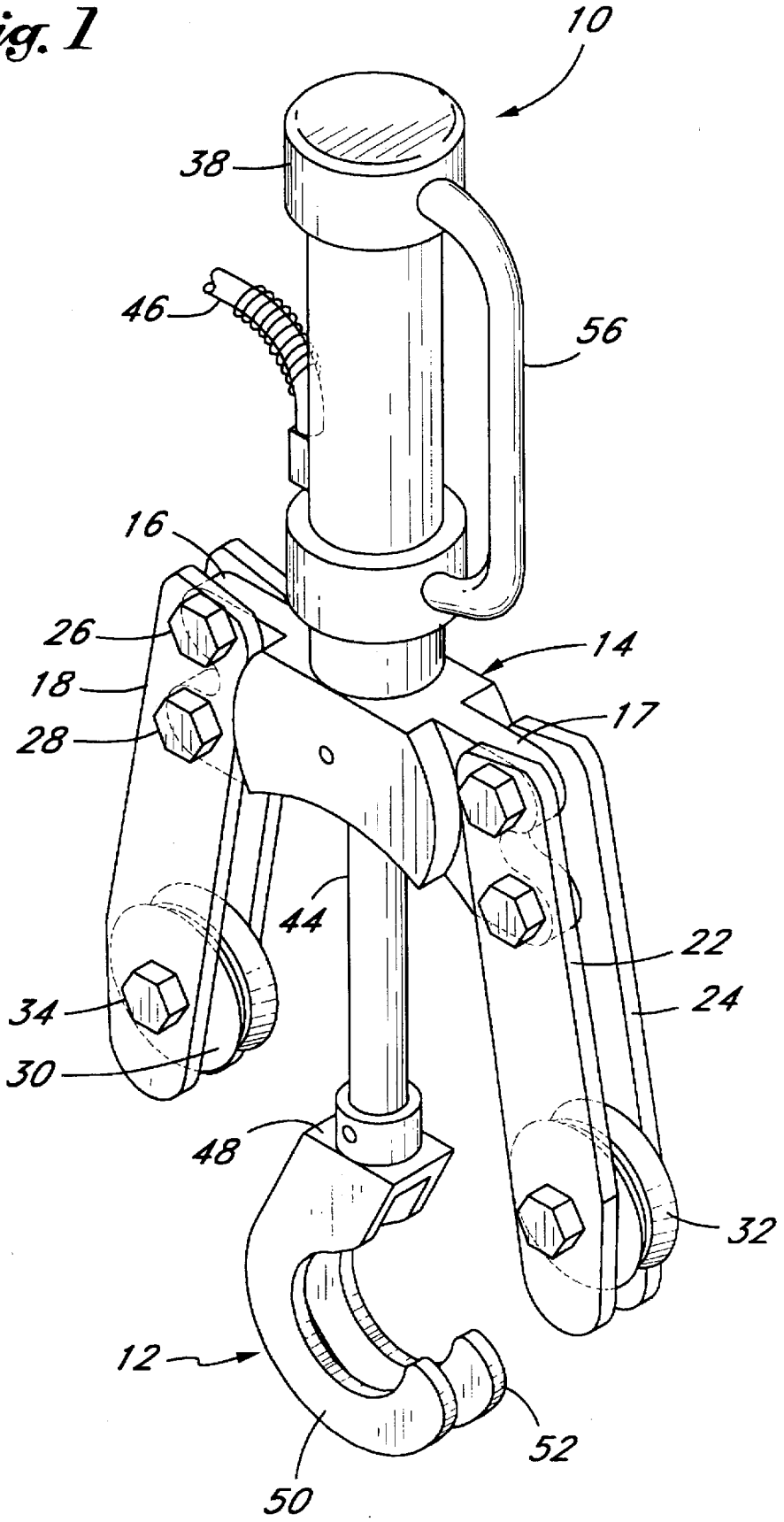
FIG. 1 is an isometric view of the portable small rebar bending machine of this invention.

The portable small rebar bending machine of this invention is generally indicated at 10 in FIGS. 1, 2, 3, 4, and 5. The rebar bending machine 10 illustrated in FIGS. 1, 2, 3 and 4 uses a first preferred bending die which comprises bending hook 12. Rebar bending machine 10 has a frame 14 which integrally carries ears 16 and 17. Two anvil supports are bolted against each ear. Anvil supports 18 and 20 are bolted against opposite sides of ear 16, while anvil supports 22 and 24 are bolted against opposite sides of ear 17. Bolts 26 and 28 extend through aligned bolt holes, in anvil support 18, ear 16 and anvil support 20. Nuts are tightened on the bolts to securely clamp those anvil supports to the frame. Similarly, bolts extend through aligned holes in anvil support 22, ear 17 and anvil support 24 to securely attach those anvil supports to the frame. The outer ends of the anvil supports are spaced in accordance with the parallel faces of the ears, and anvils 30 and 32 are respectively positioned between pairs of anvil supports.

The anvils 30 and 32 are preferably each in the form of a grooved wheel. Bolts 34 and 36 extend through corresponding aligned holes in pairs of anvil supports and respectively through anvils 30 and 32. Nuts on the bolts 34 and 36 hold the anvils in place. It is not necessary that the anvils rotate, but the structure can be configured for their rotation by providing shoulder bolts which permit tightening of the nuts without binding of the anvils. The anvils 30 and 32 can be readily removed and replaced by removal of the bolts 34 and 36. This may be necessary to change anvil size.

Actuating cylinder 38 has a threaded nose 40 which screws into the corresponding threaded hole 42 in frame 14. This attaches the cylinder to the frame. The threaded hole 42 extends through the frame, and piston rod 44 extends through the hole (see FIG. 3). A set screw in the frame engages upon the threads 40 on the cylinder to retain it in position. The set screw is seen in FIGS. 1, 2, 3 and 4.

The actuating cylinder 38 has a conventional cylindrical interior surface in which is engaged a piston. The ends of the cylinder are closed to define head end and rod end sides of the piston. Fluid fittings are provided on the cylinder to permit the introduction of fluid under pressure to the rod end of the cylinder. This causes retraction of the piston rod from the extended position shown in FIGS. 1, 2 and 3 to the withdrawn position shown in FIG. 4. The introduction of hydraulic fluid under pressure is controlled from a conventional fluid pressure source, and it is introduced to the rod under the cylinder through hydraulic hose 46. The piston may be extended from the cylinder when hydraulic fluid pressure is removed from hydraulic hose 46 by means of a spring in the head end of the cylinder or by means of another appropriate fluid connection. Hydraulic fluid is preferred because higher pressures can be achieved than can be achieved by compressed air at the usual job site. Furthermore, the cylinder 38 is smaller and lighter for particular tension force in piston rod 44 when high pressure hydraulic fluid is used to actuate the piston, as compared to job site compressed air.

Bending hook 12 is a bending die carrier. It comprises a yoke 48 which is attached to the outer end of piston rod 44. A convenient attachment is by the screw threads seen in FIGS. 2, 3 and 4. A cross pin or set screw prevents unscrewing. The yoke carries hook arms 50 and 52, which are curved to form hooks. The hooks are spaced by means of the yoke. The spacing between the hooks is at least equal to the largest diameter of rebar for which the bending machine 10 is intended.

Figure 2:
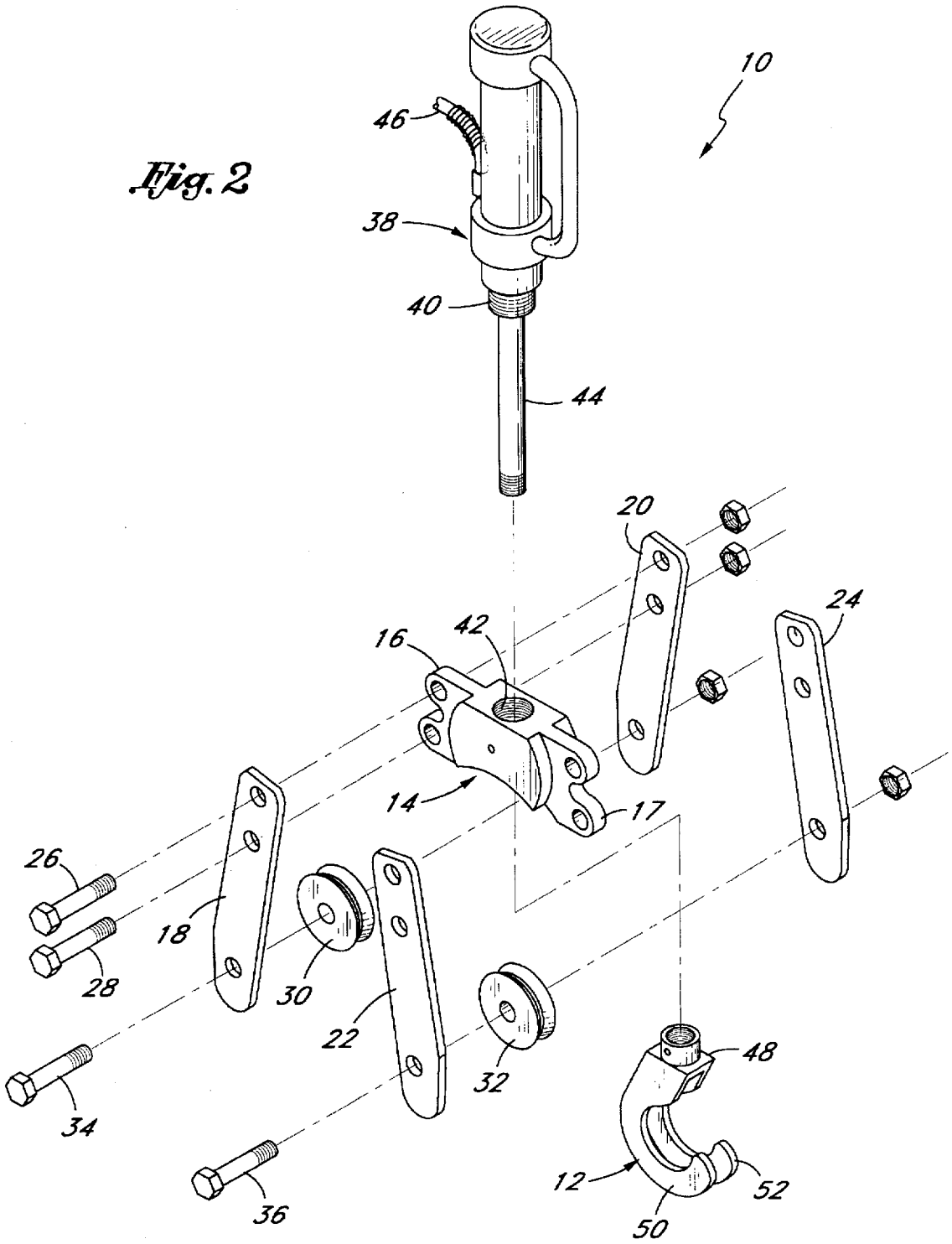
FIG. 2 is a similar isometric view thereof on reduced scale with some of the parts shown in exploded positions.
Figure 3:
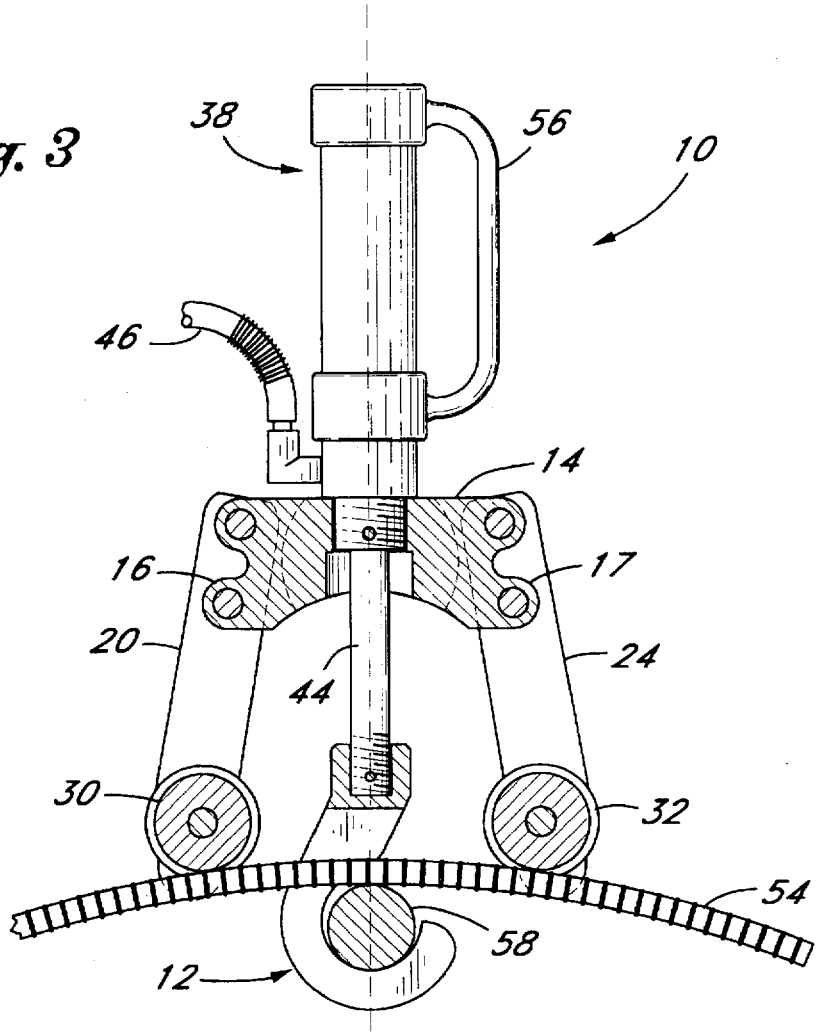
FIG. 3 is a side-elevational view thereof, showing the machine engaged on a small rebar and beginning to make a bend therein.
Figure 4:
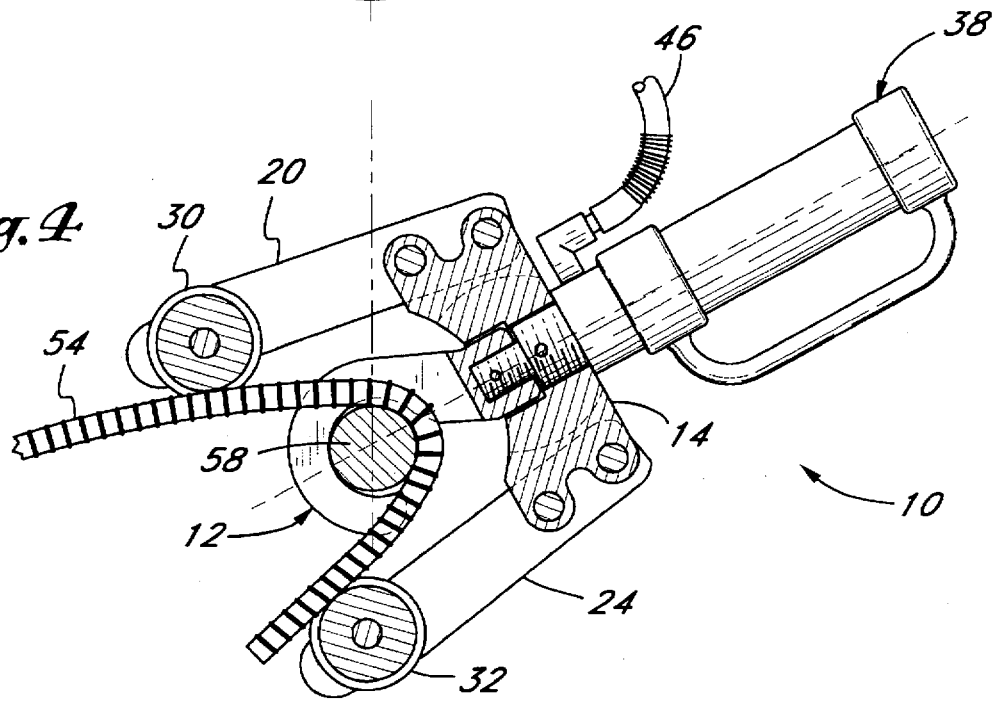
FIG. 4 is a view similar to FIG. 3, showing completion of the bend.

FIGS. 3 and 4 show the manner in which the small rebar bending machine 10 is employed. The machine is brought to the rebar 54 which requires bending. Handle 56 is secured to the cylinder and is convenient for moving and placing the bending machine 10. The machine is positioned so that the rebar 54 lies against the anvils 30 and 32 and between the hook arms 50 and 52 with the hook arms extended. The rebar 54 shown in FIGS. 3 and 4 represents the spiral wrapping of rebar around a group of heavy upright rebars in a rebar assembly such as for a concrete column. Rebar 58 represents one of those upright rebars, and it is desired to terminate the rebar 54. As noted above, it is desired that the spiral rebar 54 be terminated by placing therein a bend of at least 135 degrees. The upright rebar 58 is engaged in the bending hook 12. Fluid pressure is supplied in hose 46 moving the piston rod 44 upwardly, as seen in FIGS. 1, 2 and 3, to bring the bending die into engagement with the rebar 54. Continued application of fluid pressure to the cylinder causes retraction of the piston rod. The anvil wheels 30 and 32 move down the rebar 54, in relationship to the rebar 58, causing a bend of the rebar 54 around the rebar 58. The terminal position is shown in FIG. 4 where the bend in rebar 54 is at least 135 degrees to terminate the rebar.

To remove the bending machine from the now bent rebar, the hydraulic pressure is released. The released pressure permits a spring in the back of the cylinder to extend the piston rod to a position where the hook 12 can be disengaged from the rebar 58. This frees the rebar bending machine 10 to be moved to a new location for further bending.

Figure 5:
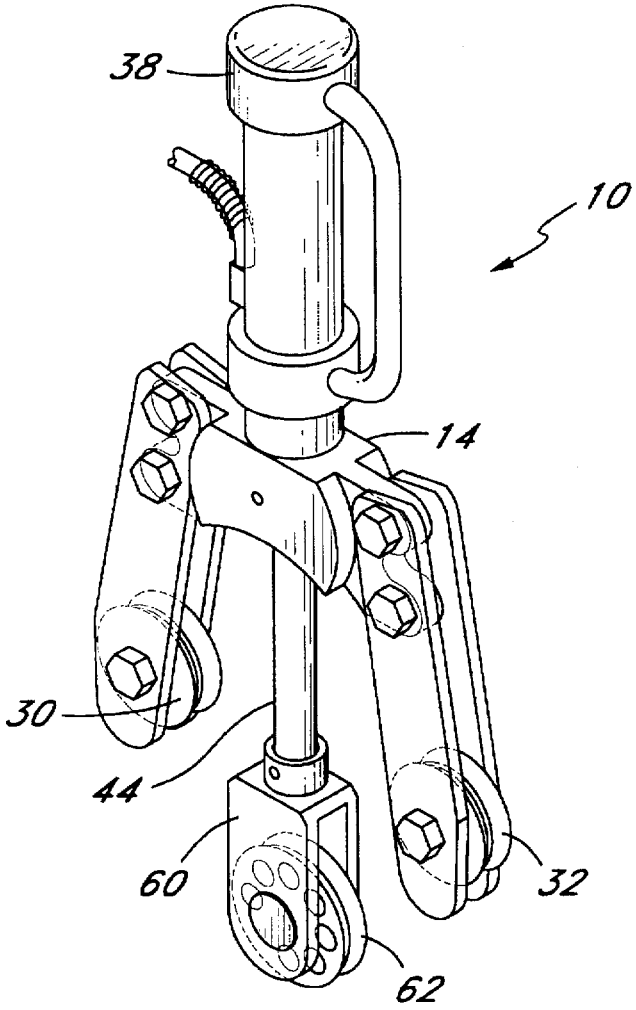
FIG. 5 is an isometric view, similar to FIG. 1, but on a reduced scale, of a second preferred embodiment of the portable small rebar bending machine of this invention.
Figure 7:
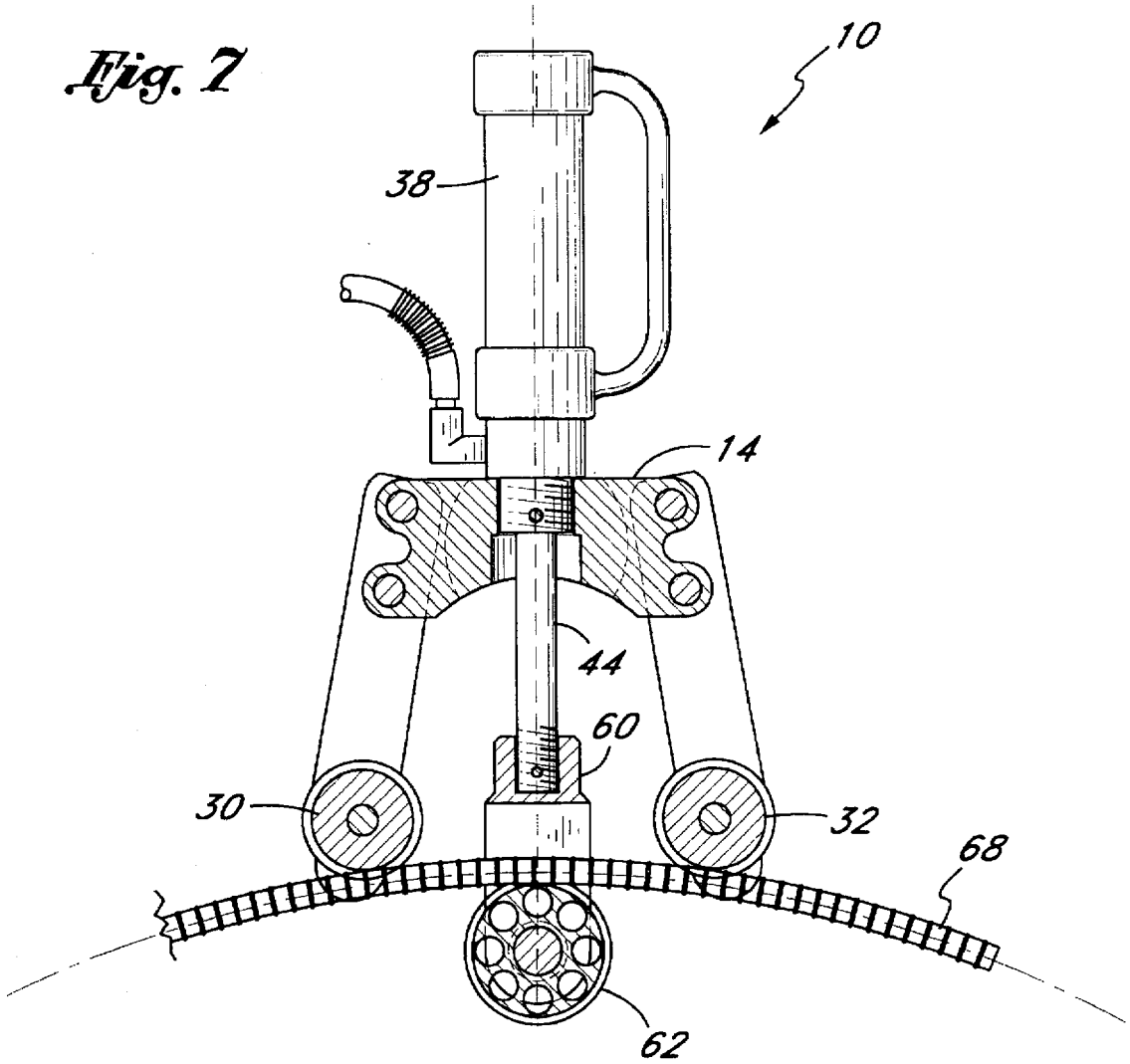
FIG. 7 is a side-elevational view of the rebar bending machine of FIG. 5 showing the second preferred embodiment of the portable small rebar bending machine of this invention engaged on a small rebar and beginning its bend.

FIGS. 5 and 7 show the portable small rebar bending machine 10 as having the same frame 14, anvil supports mounted on the frame, anvils 30 and 32, as well as actuating cylinder 38 and its piston rod 44. Yoke 60 is secured to the end of piston rod 44 by means of screw threads and is secured against rotation by a set screw or cross pin, as illustrated. The yoke 60 has two arms which are spaced to receive therebetween the rebar bending die wheel 62. Pivot pin 64 is positioned through an appropriate hole in each of the arms of yoke 60 and through the bending die 62 therebetween. Since it is anticipated that the pivot pin 64 will be regularly removed, instead of having a nut securing it in place, it has a cross cotter pin 66. The bending die wheel has a V-shaped edge like anvils 30 and 32 so that a rebar can be engaged therein.

Figure 6:
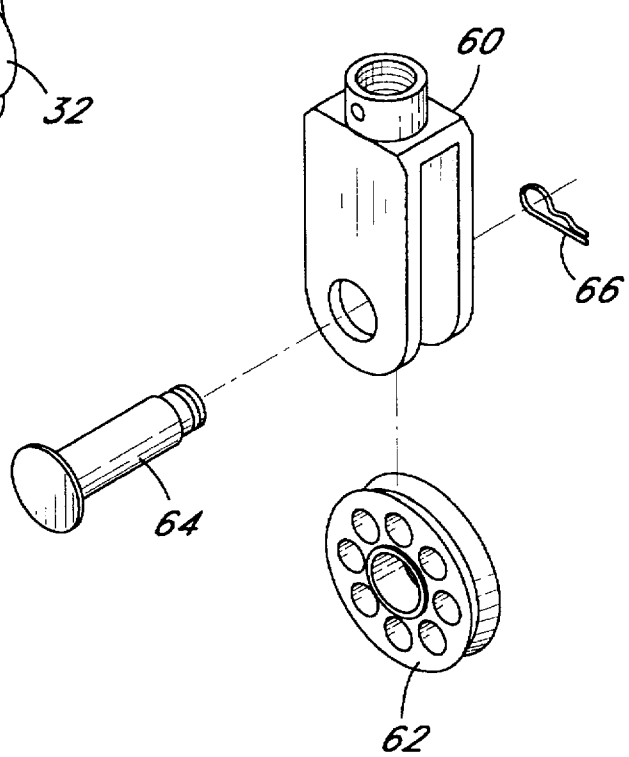
FIG. 6 is an exploded view on enlarged scale of the bending die and yoke of the machine of FIG. 5.

In the case of the portable small rebar bending machine 10 shown in FIGS. 5, 6 and 7, the piston rod 44 is extended and the die wheel 62 is removed by pulling pin 64. The anvils 30 and 32 are placed against the rebar 68, as shown in FIG. 7. In this case, the arms of the yoke 60 embrace the rebar 68. In that position, the die wheel 62 is put in place between the arms of the yoke, the pivot pin 64 is replaced and is retained by cotter pin 66. In some cases, the die wheel 62 can be slipped over the end of the rebar 68. Now, hydraulic fluid under pressure is introduced into the rod end of cylinder 38 to retract the piston rod 44 into the cylinder in the upward direction in FIGS. 5 and 7. This action bends the rebar between the anvils. A 135 degree bend is made in rebar in the same way as illustrated in FIG. 4. In this case, the die wheel 62 is used because the end termination bend of rebar 68 is not around another rebar in the rebar assembly. After completion of the bend, the bending machine 10 is removed from the rebar by releasing the pressure in the cylinder so that the spring extends the piston rod and die wheel 62. Since the bending machine 10 is only used to make termination bends at the end of the rebar with the die wheel 62 extends, the die wheel 62 can be removed from the end of the bent rebar for removal of the bending machine.

In use, the rebar bending machine 10 is brought to the job site along with its power supply. Depending on the size of the cylinder 38 and the pressure of the conventionally available air at the job site, air may be used as the fluid under pressure. However, in view of the need for lightness and compactness of the rebar bending machine 10, it is usually configured with a smaller cylinder useful with high pressure hydraulic fluid. Thus, the rebar bending machine 10 is brought to the job site together with its hydraulic power supply. The hydraulic power supply may be electrically powered or compressed-air powered. The power supply also has the capability of selectively applying fluid under pressure to the hydraulic hose 46 to move the piston and to release the pressure to permit the piston to return to the unactuated position shown in FIGS. 1 and 5. The cylinder 38 has a spring therein to extend the piston rod 44 to the position shown in FIGS. 1, 2 and 3 when no fluid pressure is applied.

The rebar bending machine 10 is brought to the rebar 54 which is to be bent. The anvils 30 and 32 are engaged against the rebar, and the rebar is positioned between the arms of the bifurcated hook 12. Intersecting rebar 58 is placed in the hook. Thereupon, hydraulic fluid under pressure is applied to the hose 46, and the piston rod 44 is retracted. This pulls rebar 58 against the rebar 54 and the rebar 54 against the anvils 30 and 32. Continued motion of the piston into the cylinder causes bending. The rebar 54 is held in position by the grooved configuration of the anvil wheels. The groove faces are V-shaped, with a clearance groove at the bottom of the V. When bending is complete, the piston is extended by release of hydraulic fluid pressure so that the spring extends the bending hook. When released, the hook can be released from the rebar 58, and the rebar bending machine 10 can be taken away from that bending site and taken to the next bending site. If it becomes difficult to remove the machine due to clearances after bending, the bolts holding the anvil supports and/or the anvils can be removed to improve removal clearances. This is normally not required.

The rebar bending machine 10 shown in FIGS. 5, 6 and 7 is used in a similar way to create a terminal bend in rebar. However, the die wheel 62 is used when the terminal bend is not going to be placed around another rebar in the rebar assembly. Thus, the rebar bending machine 10 is inserted onto the end of the rebar to be terminated with that end passing through the bifurcated yoke 60 and above the die wheel 62. Thereupon, the bending machine is ready for the application of hydraulic fluid under pressure to cause bending. At the completion of the bend, the piston is released and the die wheel 62 is unhooked from the now terminal bend on the rebar. In case it is difficult to remove the rebar bending machine 10, as configured in FIG. 5, from the terminal bend in the rebar, the pivot pin 64 and bending die wheel 62 are removed to permit removal of the machine from the location of that bend.

This invention has been described in its presently preferred best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. First and second rebars and a portable rebar bending machine for bending the first rebar around the second rebar, said rebar bending machine comprising:

a frame;

first and second anvils mounted on said frame, said first and second anvils being spaced from each other to define a rebar line therebetween, the first rebar received against and extending between said first and second anvils substantially along said rebar line; and a cylinder mounted on said frame, said cylinder having a piston rod extending therefrom, and rebar engagement means mounted on said piston rod and spaced from said rebar line to engage the second rebar so that the first rebar is disposed between said anvils and the second rebar, said piston rod moving by means of adding fluid pressure to said cylinder so that said rebar engagement means moves the second rebar towards the first rebar and across said rebar line to cause the first rebar to be bent around the second rebar.

2. The portable rebar bending machine of claim 1 wherein said cylinder is a hydraulic cylinder.

3. The portable rebar bending machine of claim 1 wherein said cylinder is mounted on one side of said frame and said first and second anvils are mounted on the other side of said frame.

4. The portable rebar bending machine of claim 1 wherein said rebar line between said first and second anvils is on the opposite side of said anvils from said frame and said rebar engagement means is on the opposite side of said rebar line from said anvils so that bending takes place by moving said rebar engagement means toward said anvils.

5. The portable rebar bending machine of claim 4 wherein first and second anvil supports are mounted on said frame and said first and second anvils are respectively mounted on said first and second anvil supports.

6. The portable rebar bending machine of claim 4 wherein said rebar engagement means is a bending hook carried on said piston rod, said bending hook engaging and moving the second rebar towards said first and second anvils for bending the first rebar around the second rebar.

7. The portable rebar bending machine of claim 6 wherein said bending hook is bifurcated so as to have a pair of opposing arms, and said rebar line between said first and second anvils passes between the arms of said bifurcated hook so that the first rebar to be bent is placed between the arms of said bifurcated hook, said bifurcated bending hook engaging the second rebar.

8. The portable rebar bending machine of claim 7 wherein said cylinder is a hydraulic cylinder.

9. The portable rebar bending machine of claim 7 wherein said cylinder is attached to said frame so that said cylinder is on the opposite side of said frame from said first and second anvils.

10. A portable rebar bending machine comprising:

a frame;

first and second spaced anvils mounted on said frame, said anvils defining a straight line therebetween along which a straight rebar is positioned for bending;

a fluid cylinder mounted on said frame, said fluid cylinder having a piston rod which can be moved with respect to said cylinder and said frame by the introduction of fluid pressure into said cylinder, said piston rod being positioned so that its center line substantially intersects said straight line between said first and second anvils;

a bifurcated hook mounted on said piston rod and having a pair of opposing arms such that the rebar to be bent that is positioned along the straight line between said first and second anvils is placed between said opposing arms of said bifurcated hook; and a bending die received in and carried by said bifurcated hook to engage the rebar to be bent so that moving said hook towards said first and second anvils by means of the fluid pressure actuation of said piston rod causes said bending die to bend the rebar relative to said straight line between said anvils.

11. The portable rebar bending machine of claim 10 further comprising first and second anvil supports for mounting said first and second anvils to said frame.

12. The portable rebar bending machine of claim 10 wherein said first and second anvils comprise V-groove anvils.

13. The portable rebar bending machine of claim 10 wherein said first and second anvils are first and second grooved wheels respectively rotatably mounted on first and second anvil supports, said first and second anvil supports mounting said first and second anvils to said frame.

14. The portable rebar bending machine of claim 10, wherein said bending die that is received in and carried by said bifurcated hook is another rebar, the rebar to be bent being disposed between said another rebar and said first and second anvils.

15. A rebar to be bent and a portable rebar bending machine for bending the rebar, said portable rebar bending machine comprising:

a frame;

first and second spaced anvils mounted on said frame, said anvils defining a rebar line therebetween along which the rebar is positioned for bending;

a fluid cylinder mounted on said frame, said fluid cylinder having a piston rod which is moveable with respect to said cylinder and said frame by the introduction of fluid pressure into said cylinder, said piston rod being positioned so that its center line substantially intersects said rebar line between said anvils;

a bending die wheel coupled to said piston rod and located opposite said first and second anvils to engage the rebar to be bent below said rebar line whereby the rebar to be bent is disposed between said bending die wheel and said anvils, said bending die wheel moving towards said first and second anvils and across said rebar line by means of the fluid pressure actuation of said piston rod to cause said bending die wheel to bend the rebar relative to said rebar line between said anvils; and a bifurcated yoke mounted on said piston rod and having a pair of opposing arms, said bending die wheel mounted between said opposing arms and the rebar to be bent extending between said opposing arms and lying in engagement with said bending die wheel for moving towards said first and second anvils with said bending wheel die.

16. The portable rebar bending machine of claim 15 wherein said bending die wheel is removably mounted between the opposing arms of said bifurcated yoke.

17. The portable rebar bending machine of claim 15 wherein said bending die wheel has a V-shaped groove extending therearound.

* * * * *